US007574776B2

(12) United States Patent
Lawless

(10) Patent No.: US 7,574,776 B2
(45) **Date of Patent: *Aug. 18, 2009**

(54) PRY BAR HANDLE

(75) Inventor: John C. Lawless, Charlemont, MA (US)

(73) Assignee: Mayhew Steel Products, Inc.MA (US)

( * ) Notice: Subject to any disclaimer, the term of this patent is extended or adjusted under 35 U.S.C. 154(b) by 32 days.

This patent is subject to a terminal disclaimer.

(21) Appl. No.: 11/269,223

(22) Filed: Nov. 8, 2005

(65) Prior Publication Data

US 2006/0075606 A1 Apr. 13, 2006

Related U.S. Application Data

(60) Continuation of application No. 10/891,816, filed on Jul. 15, 2004, now Pat. No. 7,293,331, which is a division of application No. 10/420,432, filed on Apr. 22, 2003, now Pat. No. 6,772,994.

(51) Int. Cl.
*B25G 1/10* (2006.01)

(52) U.S. Cl. ..... 16/436; 16/420; 16/110.1; 16/421; 16/DIG. 12; 16/DIG. 19

(58) Field of Classification Search ..... 16/430, 16/110.1, 421, 431, 436, DIG. 12 X, DIG. 19 X; 81/177.1, 177.4, 177.8, 900, 489, 436
See application file for complete search history.

(56) References Cited

U.S. PATENT DOCUMENTS

| | | | | | |
|---|---|---|---|---|---|
| D256,547 | S | * | 8/1980 | Holland-Letz | D8/83 |
| D256,646 | S | * | 9/1980 | Painter et al. | D7/542 |
| 4,552,713 | A | * | 11/1985 | Cavicchioli | 264/162 |
| D447,926 | S | * | 9/2001 | Chen | D8/107 |
| 6,471,186 | B1 | * | 10/2002 | Lawless | 254/25 |
| 6,772,994 | B1 | * | 8/2004 | Lawless | 254/25 |

FOREIGN PATENT DOCUMENTS

FR 2736296 A3 * 1/1997

* cited by examiner

*Primary Examiner*—Patricia Engle
*Assistant Examiner*—Mark Williams
(74) *Attorney, Agent, or Firm*—Lackenbach Siegel, LLP

(57) ABSTRACT

A pry bar has generally octagonal cross-section handle with a grip portion having four rounded surfaces formed of a soft elastomeric material and four alternating surfaces formed of hard thermoplastic material. The elastomeric material rounded surfaces are formed with pluralities of small orifices. The handle is formed with an inner hard thermoplastic core and molded over outer elastomeric cover. A metal impact cap is fixed secured in the handle proximate end.

10 Claims, 3 Drawing Sheets

FIG.4
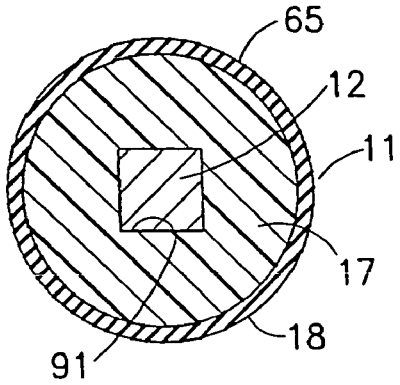
FIG.5
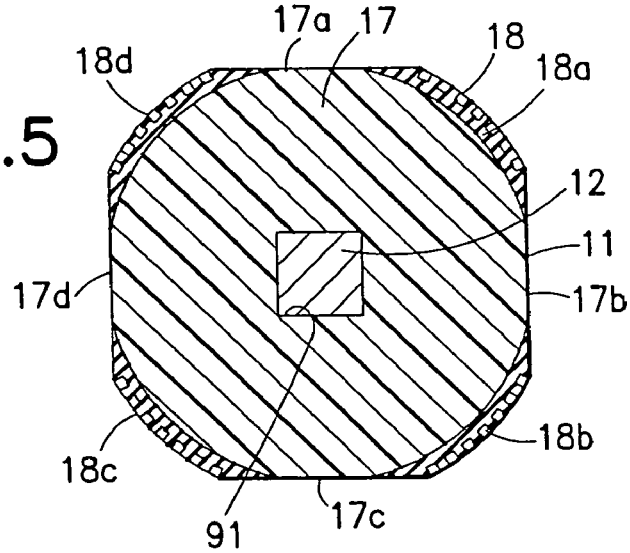
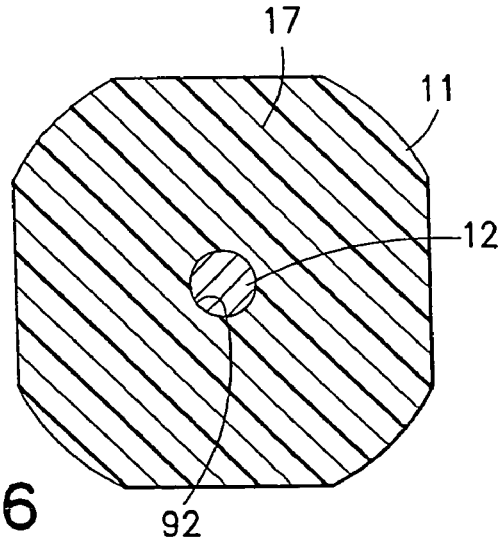
FIG.6

PRY BAR HANDLE

PRIOR RELATED APPLICATIONS

This application is a continuation of Ser. No. 10/891,816, filed Jul. 15, 2004 now U.S. Pat. No. 7,293,331, which is a divisional of application Ser. No. 10/420,432, filed Apr. 22, 2003, now U.S. Pat. No. 6,772,994, granted Aug. 10, 2004, and incorporates the prior related applications in their entirety and claims priority thereto by reference herein.

FIELD OF THE INVENTION

This invention relates to hand tools and hand tool handles. This invention specifically relates to pry bars and pry bar handles. This invention specifically relates to an ergonomic handle for hand tools particularly a pry bar.

BACKGROUND AND DISCUSSION OF THE PRIOR ART

In general, pry bars are of all metal construction and are cumbersome to grip and use. Often the user has to grip a polygonal cross-sectional metal bar portion of the pry bar. One such prior art construction is disclosed in U.S. Pat. No. 6,058,809 to Flanz.

A wrecking tool is disclosed in U.S. Patent application Publication No. 2002/0134971 to Christensen. The Christensen tool has an elongate octagonal cross-sectional metal handle or bar stock portion. A non-octagonal handgrip is attached to the octagonal metal bar.

It is generally known to provide a soft elastomeric molded over cover on a molded hard thermoplastic core for improved grip for knives, screwdrivers, and the like bladed tools. Such prior art constructions are disclosed in Sanelli, U.S. Pat. No. 4,712,304; Gakhar, U.S. Pat. No. 5,390,572; Hoepfl, U.S. Pat. No. 5,964,009; and Panaccione, U.S. Pat. No. 5,956,799.

The pry bar art desires an improved handle so as to provide improved grip with ergonomic functionality.

It is therefore a principal object of the present invention to provide an ergonomic handle for hand tool such as a pry bar.

It is another object of the present invention to provide an improved grip hand tool and pry bar handle.

It is still a further object of the present invention to provide an ergonomic pry bar handle that is of practical design and safe and practical in use.

Present applicant is the inventor of the ergonomic pry bar handle disclosed in U.S. Pat. No. 6,471,186, granted Oct. 29, 2002, which patent and the present application are commonly assigned to Mayhew Steel Products, Inc.

SUMMARY OF THE INVENTION

A pry bar has a handle with a generally octagonal cross-section with eight grip surfaces. Four of the grip surfaces have hard thermoplastic planar surfaces and four alternating grip surfaces have rounded soft thermoplastic material surfaces. The rounded soft thermoplastic material surfaces have a plurality of rows of small orifices. The user grips the alternating surfaces for a secure ergonomic grip in pry bar operations.

BRIEF DESCRIPTION OF THE DRAWINGS

FIG. 4 is a sectional view taken along line 4-4 of FIG. 3;

FIG. 5 is a sectional view taken along line 5-5 of FIG. 3; and

FIG. 6 is a sectional view taken along line 6-6 of FIG. 3.

DESCRIPTION OF THE PREFERRED EMBODIMENT

Figure 1:
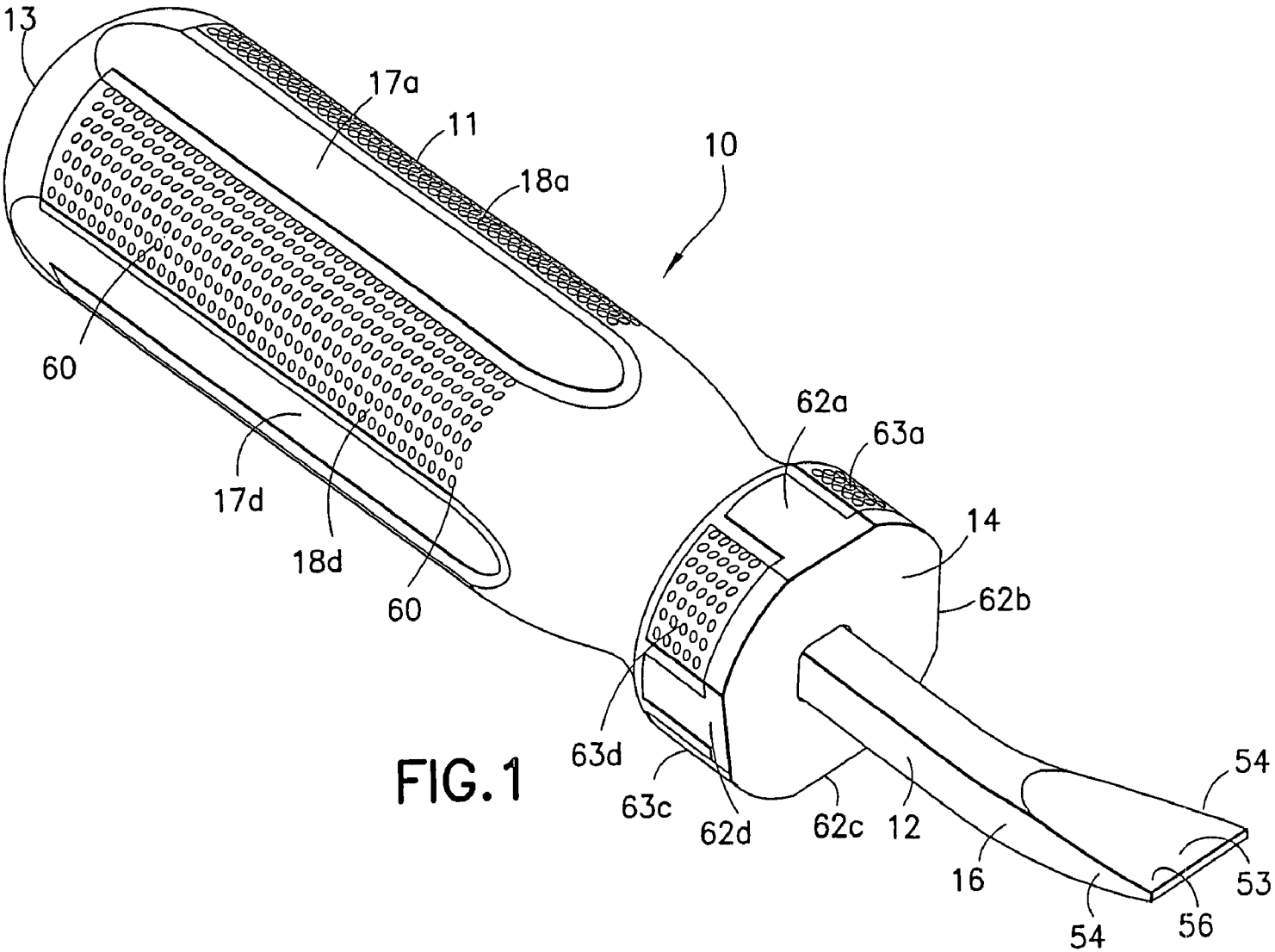
FIG. 1 is a distal end perspective view of the pry bar having the ergonomic handle of the present invention.

Referring to FIGS., there is shown pry bar 10 of the present invention. Pry bar 10, in general terms, includes handle 11 and a fixedly attached metal blade or shank 12. Handle 11 has a proximate end 13 and a planar distal end 14. Blade 12 has a proximate end 15 and a distal end 16. Handle 11 is formed of a hard thermoplastic molded core 17 and a molded over integrally bonded elastomeric soft grip cover 18, wherein cover 18 is formed of relatively soft elastomeric material. The proximate end 15 of blade 12 is securely fixedly molded in core 17, with the formation of core 17. The elastomeric cover 18 is then molded over or around specific portions of the core 17, as further discussed hereinafter. Blade 12 is of generally square cross-sectional bar stock construction and has a proximate end 15 and a distal end 16. Proximate end 15 is molded in situ with core 17, so as to be fixedly secured within handle 11, by means well known in the art.

A metal impact cap 50 is fixedly disposed at the distal end of the handle 11. Cap 50 is secured within the handle core 17 by means well known in the screwdriver handle art. Cap 50 is used, by way of example, to impact screw heads prior to driving same. In molding handle core 17 around blade 12 a rectilinear hole 91 is formed in the handle distal end. The proximate end of core 17 is however formed with a circular cylindrical hole 92 for forcibly fixedly holding metal cap 50 in the handle proximate end.

Blade distal end 16 is formed with a pry end 53. Pry end 53 has outwardly tapered sides 54, and upper and lower surfaces 56 and 57. Surfaces 56 and 57 are tapered and extend towards sharpened edge or tip 58. Tip 58 is upwardly angularly disposed with respect to shank 12.

The elastomeric cover 18 does not cover the entire core 17. Four planar thermoplastic surfaces 17*a*-17*d* are left uncovered in the grip area of the handle, as best shown in FIG. 5.

Figure 2:
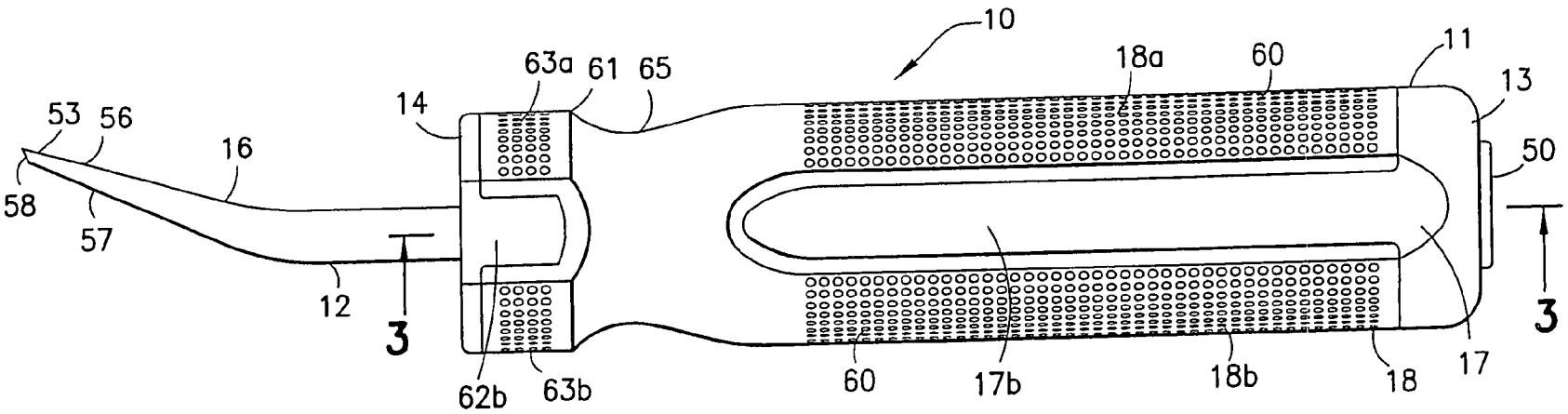
FIG. 2 is a side elevational view of the pry bar of FIG. 1.

Elastomeric material cover 18 is molded over hard thermoplastic core 17 in the handle grip portion in four curved or rounded grip portions 18*a*-18*d*, as best shown in FIGS. 2 and 5. The rounded elastomeric grip portions 18*a*-18*d* alternate with the planar hand plastic grip portions 17*a*-17*d*. Elastomeric grip portions 18*a*-18*d* are formed with a plurality of rows of small crevices or holes 60 (typical). It is believed that the surfaces 17*a*-17*d*, 18*a*-18*d* in further combination with the small holes provides improved grip and comfort for the user.

Figure 3:
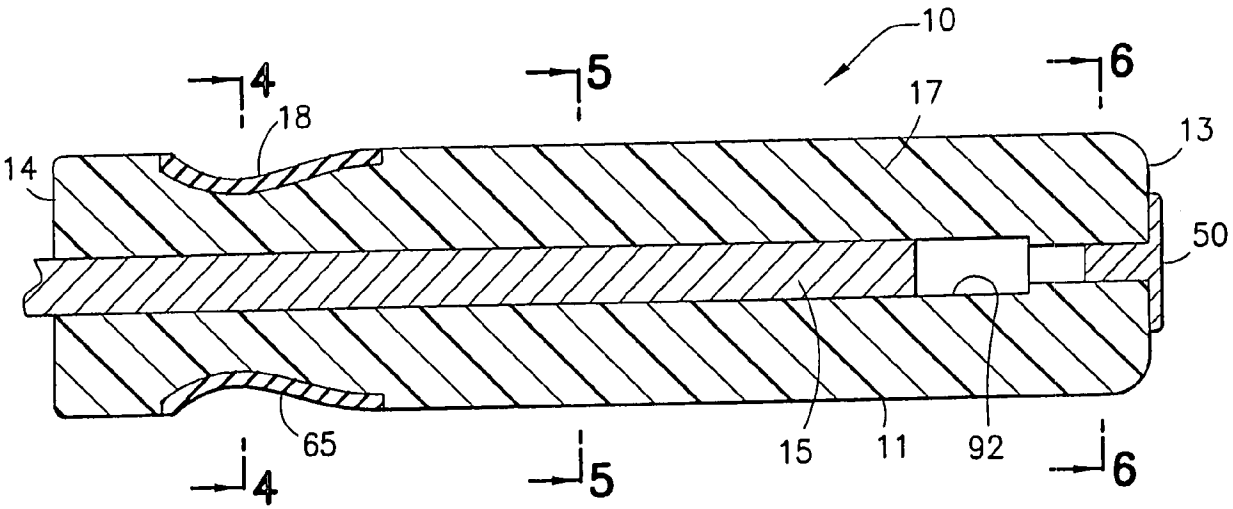
FIG. 3 is a sectional view taken along line 3-3 of FIG. 2.

Handle 11 is formed with a distal end portion 61 juxtaposed to planar end 14. Distal end portion 61 is formed with alternate hard plastic planar surfaces 62*a*-62*d*, and elastomeric rounded surface 63*a*-63*d* which are formed and configured similarly to respective surfaces 17*a*-17*d* and 18*a*-18*d*. Elastomer cover 18 extends from grip portions 18*a*-18*d* to respective distal end portions 63*a*-63*d* and entirely covers thermoplastic core 17 at cylindrical cross-sectional recessed portion 65, as best shown in FIGS. 2, 3 and 4.

In the aforesaid manner of construction, the user grips portions 18*a*-18*d* and 17*a*-17*d* and places the thumb in recessed portion 65, or if desired, on one of the distal end surfaces 63*a*-63*d* for best desired grip and comfort.

The core may be molded of hard thermoplastic using and the cover may be molded of with elastomeric material by molding methods.

The afore-discussed handle surfaces and contours, and in conjunction with the pry bar configuration and disposition with respect to the handle, provides an ergonomic pry bar.

The invention contemplates an ergonomic handle for both pry bar and other hand tools.

In the aforesaid manner of construction, there is provided a ergonomic pry bar and handle.

While the foregoing describes certain embodiments of the invention, various modifications and changes may be made within the spirit and scope of the invention, as defined by the adjoined claims.

The invention claimed is:

1. A hand tool comprising:

a thermoplastic plastic handle having a distal end, a proximate end and a grip portion disposed between the proximate end and the distal end, said grip portion comprising first surfaces and second surfaces, said handle further comprising a longitudinally extending through bore having a centerline, said through bore extends from the proximate end to the distal end, and said through bore is free of thermoplastic material; said through bore comprises a rectilinear cross-section, and said tool comprises a pry bar, said through bore rectilinear cross-section having a first cross dimension; a metal impact cap disposed within said bore at the handle proximate end, said metal impact cap comprising a proximate end and a distal end; and a blade having a proximate end and a distal end, said blade proximate end being fixedly disposed in said through bore at the handle distal end; said blade distal end being formed with an acutely angled blade edge, said blade edge being spatially disposed from said centerline so as to provide an off centerline working edge; said blade having a rectilinear cross-section, said through bore extends through the grip portion of the handle to fixedly receive the blade, said through bore proximate end portion comprising a portion having a second cross dimension, and the metal end cap is fixedly disposed in the through bore second portion; said second cross dimension being less than said first cross dimension, and wherein said blade proximate end is in facing disposition and immediately juxtaposed to said metal impact cap distal end;

said grip portion first surfaces being planar and said grip portion second surfaces being curvilinear, and further comprising elastomeric material fixedly disposed only on the curvilinear surfaces and said planar surfaces being free of said elastomeric material; whereby the grip portion elastomeric material curvilinear second surfaces in combination with the thermoplastic material planar first surfaces provide ergonomic grip and permit effective leverage force to be exerted on the pry bar blade edge.

2. The hand tool of claim 1, where wherein a cross-section of the grip portion comprises an irregular octagonal section comprising four straight lines comprising said first surfaces and four curvilinear lines comprising said second surfaces and said curvilinear lines being longer than said straight lines.

3. The hand tool of claim 1, said elastomeric material comprises holes.

4. The hand tool of claim 2, said blade rectilinear cross-section being disposed in the grip portion so that the blade rectilinear corners are facingly disposed to the curvilinear lines.

5. The hand tool of claim 1, said grip portion comprises four first surfaces and form second surfaces in alternate disposition, wherein each elastomeric material curvilinear surface is disposed between two thermoplastic planar surfaces.

6. the hand tool of claim 5, said elastorneric material comprises holes.

7. The hand tool of claim 1, said through bore comprises a step disposed between the impact cap distal end and the pry bar blade proximate end.

8. A hand tool comprising:

a thermoplastic plastic handle having a distal end, a proximate end and a grip portion disposed between the proximate end and the distal end, said grip portion comprising first surfaces and second surfaces, said handle further comprising a longitudinally extending through bore having a centerline, said through bore extends from the proximate end to the distal end, and said through bore is free of thermoplastic material; said through bore comprises a rectilinear cross-section, and said tool comprises a pry bar, said through bore rectilinear cross-section having a first cross dimension; a metal impact cap disposed within said bore at the handle proximate end, said metal impact cap comprising a proximate end and a distal end; and a blade having a proximate end and a distal end, said blade proximate end being fixedly disposed in said through bore at the handle distal end; said blade distal end being formed with an acutely angled blade edge, said blade edge being spatially disposed from said centerline so as to provide an off centerline working edge; said blade having a rectilinear cross-section, said through bore extends through the grip portion of the handle to fixedly receive the blade, said through bore proximate end portion comprising a portion having a second cross dimension, and the metal end cap is fixedly disposed in the through bore second portion; said second cross dimension being less than said first cross dimension, and wherein said blade proximate end is in facing disposition and immediately juxtaposed to said metal impact cap distal end;

said grip portion first surfaces being planar and said grip portion second surfaces being curvilinear, and further comprising elastomeric material fixedly disposed only on the curvilinear surfaces and said planar surfaces being free of said elastomeric material and wherein; a cross-section of the grip portion comprises an irregular octagonal section comprising four straight lines comprising said first surfaces and four curvilinear lines comprising said second surfaces, said curvilinear lines being longer than said straight lines; whereby the grip portion elastomeric material longer curvilinear second surfaces in combination with the thermoplastic material shorter planar first surfaces provide an ergonomic grip and permit effective leverage force to be exerted on the pry bar blade edge.

9. The hand tool of claim 8, said grip portion comprises four first surfaces and form second surfaces in alternate disposition, wherein each elastomeric material curvilinear surface is disposed between two thermoplastic planar surfaces.

10. The hand tool of claim 8, all said first surfaces being free of said elastomeric material.

* * * * *